US007808475B2

(12) United States Patent
Brown

(10) Patent No.: US 7,808,475 B2
(45) Date of Patent: Oct. 5, 2010

(54) PHOTO-LUMINESCENT BACKLIGHT SUPPORT FOR POWER SAVING

(75) Inventor: Shawn M. Brown, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 805 days.

(21) Appl. No.: 11/786,675

(22) Filed: Apr. 12, 2007

(65) Prior Publication Data

US 2008/0252575 A1 Oct. 16, 2008

(51) Int. Cl.
*G09G 3/32* (2006.01)

(52) U.S. Cl. ..... 345/102; 345/207; 349/61; 349/62; 349/63; 349/64; 349/65; 349/66; 349/67; 349/68; 349/69; 349/70; 349/71

(58) Field of Classification Search ..... 345/102, 345/107; 349/61–71
See application file for complete search history.

(56) References Cited

U.S. PATENT DOCUMENTS

| | | | | |
|---|---|---|---|---|
| 3,270,201 | A * | 8/1966 | Hardesty | 250/458.1 |
| 4,453,434 | A * | 6/1984 | Lissy | 81/57.29 |
| 5,594,570 | A * | 1/1997 | Hirata et al. | 349/129 |
| 6,364,498 | B1 | 4/2002 | Burbank | |
| 6,626,552 | B2 | 9/2003 | Uehara et al. | |
| 6,894,750 | B2 | 5/2005 | Zhuang et al. | |
| 7,015,893 | B2 | 3/2006 | Li et al. | |
| 7,019,714 | B2 | 3/2006 | Uchida et al. | |
| 7,248,244 | B2 * | 7/2007 | Akiyama | 345/102 |
| 7,453,434 | B2 * | 11/2008 | Takahashi et al. | 345/102 |

(Continued)

FOREIGN PATENT DOCUMENTS

EP 1731949 A1 12/2006

(Continued)

OTHER PUBLICATIONS

Energy-Adaptive Display System Designs for Future Mobile Environments http://www.hpl.hp.com/techreports/2003/HPL-2003-91.pdf.

(Continued)

*Primary Examiner*—Richard Hjerpe
*Assistant Examiner*—Jeffrey S Steinberg
(74) *Attorney, Agent, or Firm*—Merchant & Gould P.C.

(57) ABSTRACT

Backlight support is provided for flat panel displays through use of phospho-luminescent materials. Photo-luminescent materials are integrated into a flat panel display such as an LCD display as a back panel substrate or by embedding in display pixels. When ambient light levels exceed a predetermined threshold the material is activated allowing a reduction in active backlight power. The active backlight may be provided by an electrically supported system such as an ELP, a light pipe, an LED, etc. By reducing the power of the active backlight in an analog manner or through decreasing the duty cycle, an overall power savings is accomplished for the display. By embedding different photo-luminescent materials that operate at different wavelengths, color display may be enhanced while reducing power consumption. Display properties, such as transparency, contrast, etc., may be adjusted to affect phospho-luminescent backlight support.

20 Claims, 6 Drawing Sheets

U.S. PATENT DOCUMENTS

2002/0063519 A1* 5/2002 Rikkinen et al. ..... 313/506
2004/0100432 A1 5/2004 Hajto et al.
2004/0104885 A1 6/2004 Adler
2004/0263045 A1 12/2004 Smith
2005/0023972 A1* 2/2005 Lewandowski et al. ..... 313/509
2006/0262111 A1 11/2006 Kerofsky
2006/0280969 A1 12/2006 Seo et al.
2007/0070264 A1* 3/2007 Fujita et al. ..... 349/61

FOREIGN PATENT DOCUMENTS

WO WO 2006 045424 A1 5/2006

OTHER PUBLICATIONS

Liquid Crystal Modulated Photoluminescent Displays (PL-LCSs) http://www-g.eng.cam.ac.uk/photonics/sid97.pdf.

* cited by examiner

PHOTO-LUMINESCENT BACKLIGHT SUPPORT FOR POWER SAVING

BACKGROUND

Battery life is an ongoing challenge for portable device designers. The backlight of these devices is one of the higher power consumption components and also one of the more commonly used components. Longer battery life means a more compelling device to be used by consumers. The backlight combined with additional components may result in short battery life and therefore require the user to continually make sure they have a full charge day to day. A goal of developing compelling mobile devices is to minimize the micro-managing of power usage.

Similarly, power consumption in large display panels is a challenge for display designers. Some of these devices are used as advertising panels powered by solar energy. Others are powered from the electricity grid. Regardless of the power source, any reduction in power consumption of display panels is a desired design outcome for engineers, who utilize various backlighting techniques.

SUMMARY

This summary is provided to introduce a selection of concepts in a simplified form that are further described below in the Detailed Description. This summary is not intended to identify key features or essential features of the claimed subject matter, nor is it intended as an aid in determining the scope of the claimed subject matter.

Embodiments are directed to providing backlight support through photo-luminescent materials to flat panel displays such as LCD displays to reduce power consumption due to existing backlight methods. Photo-luminescent materials may be implemented in various ways to be charged when ambient light conditions are adequate and provide support to backlighting, when the ambient light conditions are inadequate.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

FIG. 4A and FIG. 4B illustrate two example scenarios of backlight circuit power usage when the photoluminescence backlight support is turned off and turned on;

DETAILED DESCRIPTION

As briefly described above, backlight support through photo-luminescent materials is provided to flat panel displays to reduce power consumption due to existing backlight methods. In the following detailed description, references are made to the accompanying drawings that form a part hereof, and in which are shown by way of illustrations specific embodiments or examples. These aspects may be combined, other aspects may be utilized, and structural changes may be made without departing from the spirit or scope of the present disclosure. The following detailed description is therefore not to be taken in a limiting sense, and the scope of the present invention is defined by the appended claims and their equivalents.

While the embodiments will be described in the general context of devices, circuits, and software program modules, those skilled in the art will recognize that aspects may also be implemented in various combinations of these aspects. Furthermore, various photo-luminescent materials may be used to implement embodiments.

Generally, flat panel displays are included in consumer devices as well as specialized applications. Moreover, those skilled in the art will appreciate that embodiments may be practiced with other device configurations, including handheld devices, microprocessor-based or programmable consumer electronics, and the like. Software control aspects of embodiments may also be practiced in distributed computing environments where tasks are performed by remote processing devices that are linked through a communications network. In a distributed computing environment, program modules may be located in both local and remote memory storage devices.

Operational control of backlight support according to embodiments may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process.

Figure 1A:
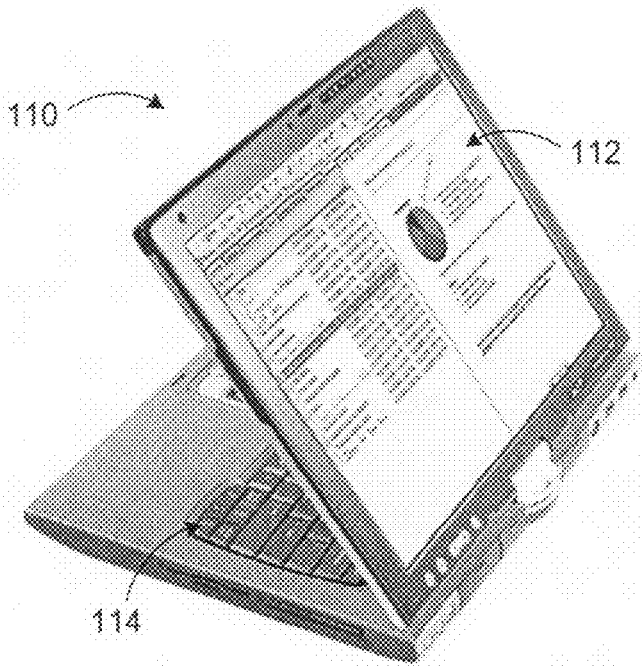
FIGS. 1A, 1B, and 1C illustrate various example devices with flat displays such as LCD displays, where photoluminescence based backlight support may be implemented.
Figure 1B:
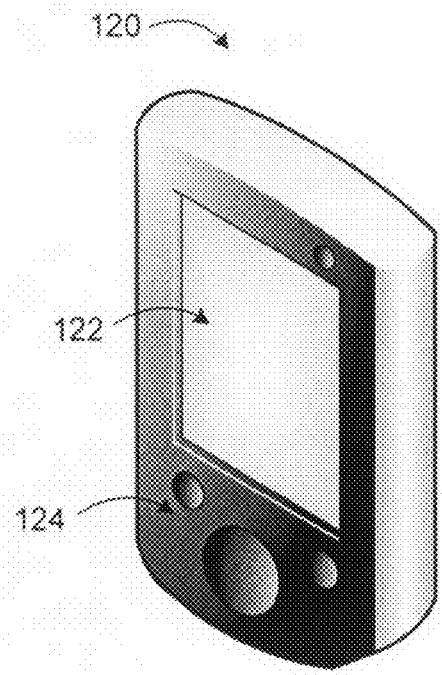
Figure 1C:
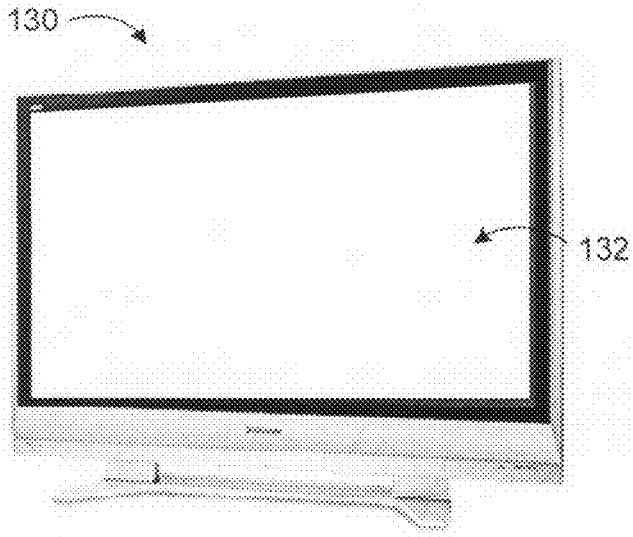

Referring to FIGS. 1A, 1B, and 1C, various example devices with flat displays such as LCD displays, where photoluminescence based backlight support may be implemented, are illustrated. Many display technologies are used today for a variety of devices ranging from small displays in handheld devices to very large displays used for advertising panels.

Example devices include tablet computer 110 with its display 112 and keyboard 114, Personal Digital Assistant 120 with its display 122 and controls 124, and LCD television 130 with its display 132. Any one of the displays in these devices may be designed with a backlight mechanism for ease of viewing, enhancement of display features, and the like. Backlight mechanisms also vary in type and depending on the specific mechanism consume different amounts of power. The power consumption by the backlight, like any other circuit, is a design challenge to be overcome for battery life, cost of operation, performance enhancement, and the like.

According to one embodiment, a photo-luminescent substrate behind an LCD screen or other media screen may be used to reduce power consumption normally required by the standard backlight which may be a Cathode Fluorescent Lamps (light pipes), Electroluminescent Panel (ELP), or Light Emitting Diodes (LEDs). When the ambient light level sufficiently charges the photo-luminescent substrate for backlight support, the substrate beings to provide additional backlight to the display reducing a need for full power active backlight. Thus, a power supply to the active backlight may be reduced decreasing the overall power of the traditional backlight source to maintain the light intensity. This may be achieved, for example, by lowering the voltage to an LED or by reducing the duty cycle of an ELP power supply to reduce overall power consumption. In analog backlights, the voltage may simply be reduced to decrease overall power consumption based on P(watts)=I(current)*V(voltage) for DC circuits. With the combination of the traditional backlight and ambient light recharging the phosphorescent substrate, the overall power consumption for backlight may be reduced substantially.

Figure 2:
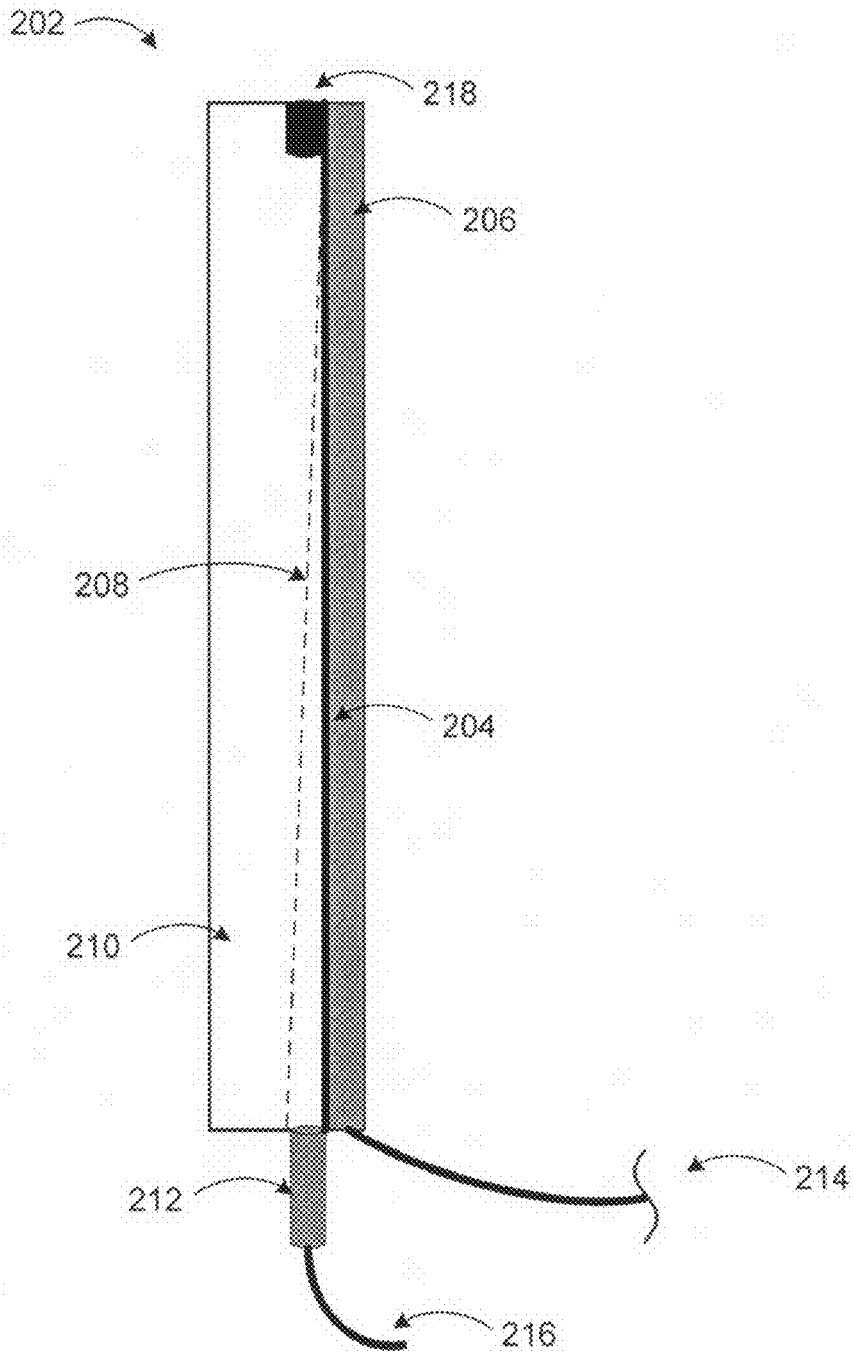
FIG. 2 illustrates a cross-sectional view of an example display with backlight support.

FIG. 2 illustrates a cross-sectional view of an example display with backlight support. Backlight may be provided in many ways to a flat display, all implementations involving one kind of power consumption or another. A photo-luminescent material based backlight support according to embodiments may help reduce the power consumption by the backlight mechanism.

Photoluminescence is a process in which a chemical compound absorbs photons, thus transitioning to a higher electronic energy state, and then radiates photons back out, returning to a lower energy state. The period between absorption and emission is typically extremely short, on the order of several nanoseconds. Under special circumstances, however, this period can be extended into minutes or hours.

Ultimately, available chemical energy states and allowed transitions between states (and therefore wavelengths of light preferentially absorbed and emitted) are determined by the rules of quantum mechanics. Electron configurations and molecular orbitals of simple atoms and molecules of a photoluminescent compound determine the wavelength of the emitted light as well as the period between absorption and emission. More complicated molecules may be implemented using computational chemistry techniques for selective wavelengths and adjustable emission periods.

The simplest photo-luminescent processes are resonant radiations, in which a photon of a particular wavelength is absorbed and an equivalent photon is immediately emitted. This process involves no significant internal energy transitions of the chemical substrate between absorption and emission and is extremely fast, on the order of 10 nanoseconds.

More complicated processes occur when the chemical substrate undergoes internal energy transitions before re-emitting the energy from the absorption event. A well known one of such effects is fluorescence, which is also typically a fast process, but in which some of the original energy is dissipated so that the emitted light photons are of lower energy than those absorbed.

An even more specialized form of photoluminescence is phosphorescence, in which the energy from absorbed photons undergoes intersystem crossing into a state of higher spin multiplicity, usually a triplet state. Once the energy is trapped in the triplet state, transition back to the lower singlet energy states is quantum mechanically forbidden, meaning that it happens much more slowly than other transitions. The result is a slow process of radiative transition back to the singlet state, sometimes lasting minutes or hours. This is the basis for "glow in the dark" substances.

Two common pigments are used in photo-luminescent materials, zinc sulfide and strontium oxide aluminate. Use of zinc sulfide for safety related products dates back to the 1930s. However, the development of strontium oxide aluminate, with a luminance approximately 10 times greater than zinc sulfide, has made this substrate a favorite among photoluminescent products. Strontium oxide aluminate based pigments are now used in exit signs, pathway marking, and other safety related signage.

Phosphorescence is a specific type of photoluminescence related to fluorescence. Unlike fluorescence, a phosphorescent material does not immediately re-emit the radiation it absorbs. The slower time scales of the re-emission are associated with "forbidden" energy state transitions in quantum mechanics. As these transitions occur less often in certain materials, absorbed radiation may be re-emitted at a lower intensity for up to several hours.

In simpler terms, phosphorescence is a process in which energy absorbed by a substance is released relatively slowly in the form of light. This is in some cases the mechanism used for "glow-in-the-dark" materials which are "charged" by exposure to light. Unlike the relatively swift reactions in a common fluorescent tube, phosphorescent materials used for these materials absorb the energy and "store" it for a longer time as the subatomic reactions required to re-emit the light occur less often.

As mentioned previously, most photo-luminescent events, in which a chemical substrate absorbs and then re-emits a photon of light, are fast (on the order of 10 nanoseconds). However, for light to be absorbed and emitted at these fast time scales, the energy of the photons involved (i.e. the wavelength of the light) must be carefully tuned according to the rules of quantum mechanics to match the available energy states and allowed transitions of the substrate. In the special case of phosphorescence, the absorbed photon energy undergoes an unusual intersystem crossing into an energy state of higher spin multiplicity, usually a triplet state. As a result, the energy can become trapped in the triplet state with only quantum mechanically "forbidden" transitions available to return to the lower energy state. These transitions, although "forbidden", still occur but are kinetically unfavored and thus progress at significantly slower time scales. Most phosphorescent compounds are still relatively fast emitters, with triplet lifetimes on the order of milliseconds. However, some compounds have triplet lifetimes up to minutes or even hours, allowing these substances to effectively store light energy in the form of very slowly degrading excited electron states. If the phosphorescent quantum yield is high, these substances will release significant amounts of light over long time scales.

Referring back to FIG. 2, display 202 includes glass lens 210 and display surface 204. In an LCD display, display surface 204 may be the actual liquid crystal display and there may be an air gap between the glass lens and the liquid crystal display. The actual display process is achieved by providing electrical signals to the display surface through connection 214 from a display controller.

Backlight may be provided to display 202 through different means. For example, a light pipe 212 may provide light into the glass lens that is diffused through the angled portion 208 across the whole display surface. Light may be provided to the light pipe from a light source through a fiber optic connection 216, or by an LED placed adjacent to the light pipe (not shown). In another embodiment, the backlight may be provided by fluorescent material covering the back of the display surface.

Photo-luminescent support for backlight may be provided by using phospho-luminescent material behind the display surface or by embedding the display surface itself with phospho-luminescent material. For example, phospho-luminescent material may be impregnated into each pixel of a display panel. A photo sensor 218 may used to detect ambient light levels for determining when the backlight support phosphorescence should be adequate and the active backlight can be reduced for power savings.

Many other configurations of display devices, backlight systems, and phosphorescent material may be employed to implement providing photo-luminescent backlight support. Furthermore, the components discussed in FIG. 2 are for illustration purposes only. Embodiments are not limited to the example components and configurations.

Figure 3A:
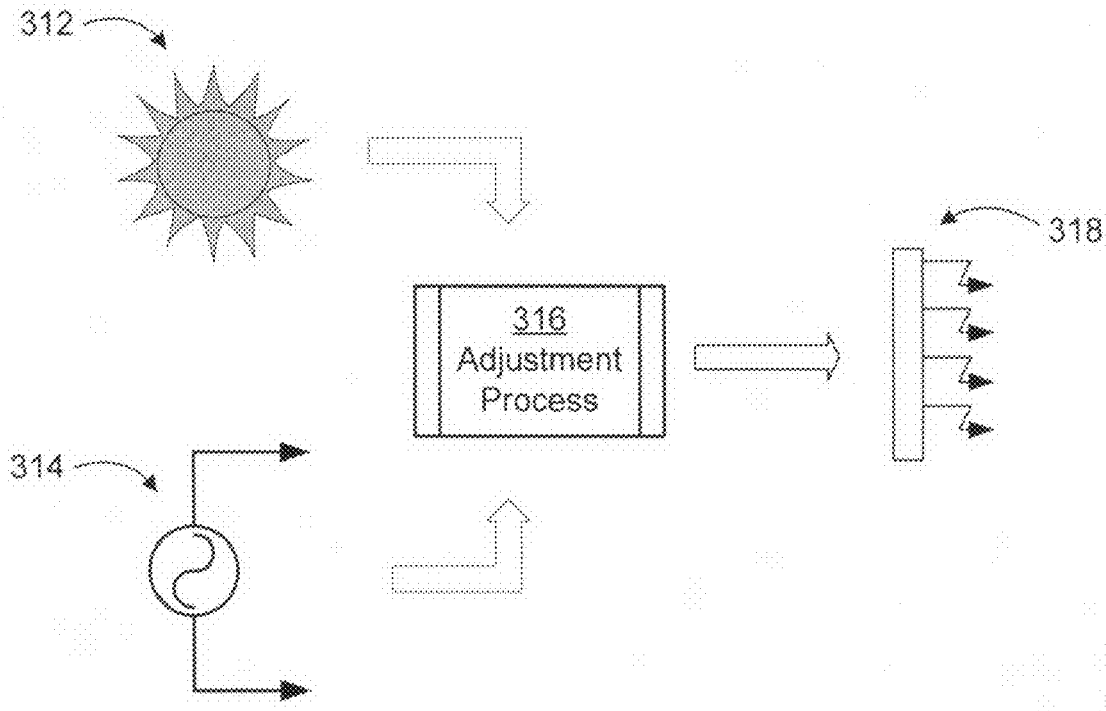
FIG. 3A and FIG. 3B are conceptual diagrams illustrating adjustment of backlight support photoluminescence under different ambient light conditions.
Figure 3B:
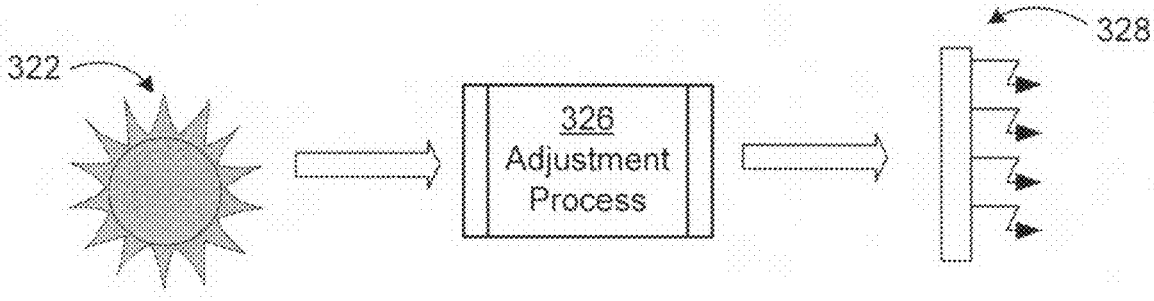

FIG. 3A and FIG. 3B are conceptual diagrams illustrating adjustment of backlight support photoluminescence under different ambient light conditions. As mentioned above, ambient light may be used to charge a photo-luminescent backlight support substrate.

Ambient light may include any optical range waves that are available to the display from the environment such as natural sunlight, artificial lighting in an environment, and the like. This portion of ambient light provided by the environment is represented by the conceptual element with reference numeral 312 in FIG. 3A.

In addition to the light from the environment, a display may be outfitted with a backlight system that provides additional lighting to the display as shown by the conceptual element 314. Backlight may be provided by a fluorescent back panel, light from an LED or analog light source (e.g. a lamp) brought through a light pipe and diffused over the display, and an ELP system. Other backlight systems are also known and implemented by those skilled in the art.

Both types of incident light may be analyzed by a module in the display to determine when and how the backlight support photoluminescence is to be turned on. Adjustment process 316 may be performed by hardware, software, or a combination of hardware and software. The adjustment process may include determination of whether the ambient light is above or below a threshold deemed to be adequate to charge the phospho-luminescent backlight support material, if the material is used in different segments (and/or different materials) which segment should be activated, and so on. When the decision is made to turn on the backlight support, phospho-luminescent substrate 318 may be activated getting charged by the ambient light and providing luminescent light to the display panel.

FIG. 3B illustrates another example of the same system with only outside ambient light being used to charge the phospho-luminescent backlight support material. According to some embodiments, an active backlight system may be completely eliminated if the light provided by the phospho-luminescent backlight support material renders sufficient backlight to the display.

Another aspect of using phospho-luminescent backlight support material, according to embodiments, is using the material to enhance color features of the display. For example, different phospho-luminescent molecules that emit light at different wavelengths may be embedded into the display panel such that each type of molecule is used to enhance the display performance at a predetermined wavelength (color). In such a scenario, the phospho-luminescent molecules may be activated based on a software control mechanism that determines the colors being displayed on the display panel and activates the phospho-luminescent molecules depending on which colors are to be enhanced.

Figure 4A:
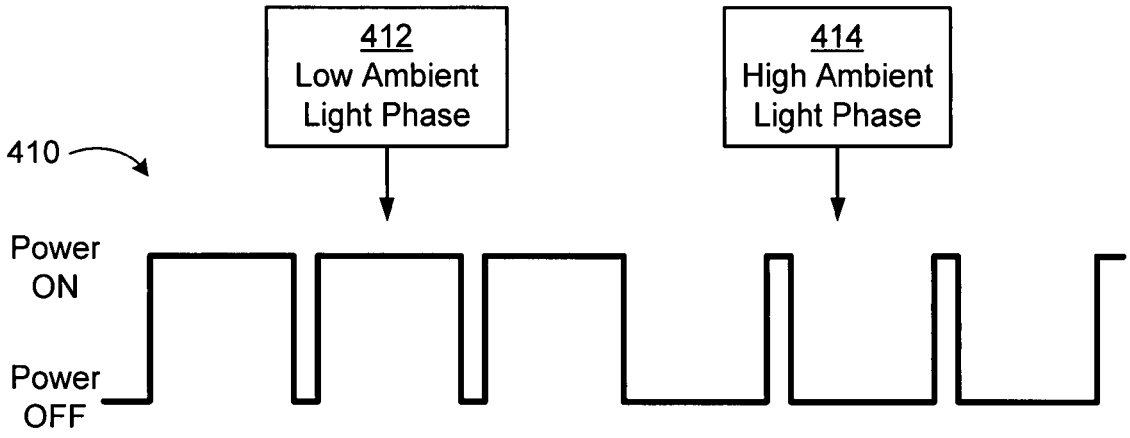
Figure 4B:
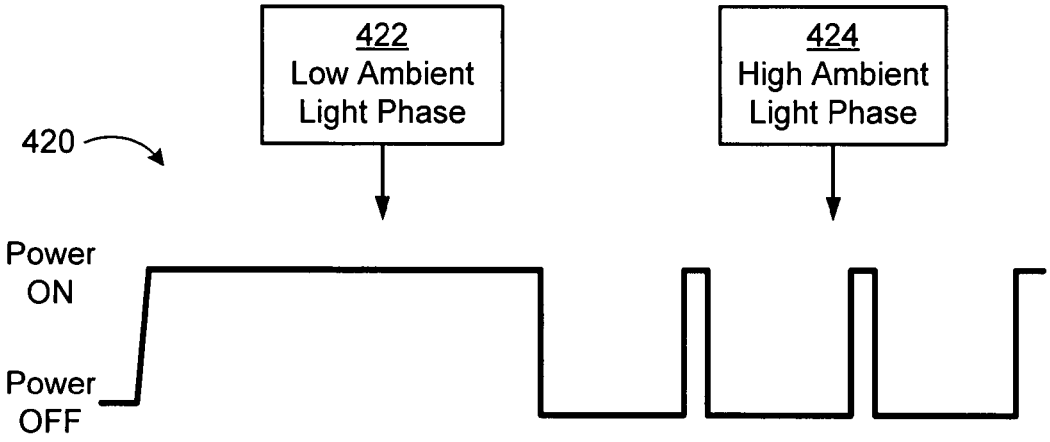

FIG. 4A and FIG. 4B illustrate two example scenarios of backlight circuit power usage when the photoluminescence backlight support is turned off and turned on. As discussed previously, backlight may be provided by an ELP. A duty cycled supply power 410 of the ELP is shown in FIG. 4A. In a low ambient light phase 412, where the ELP is the sole provider of backlight, the duty cycle may be at a higher value to provide adequate lighting to the display. When the ambient light condition improves and a high ambient light phase 414 is entered, the phospho-luminescent backlight support material may be activated and provide additional light to the display. In this phase, the duty cycle of the ELP supply power may be reduced to a lower value resulting in power savings for the display device.

When an analog light source such as a cathode fluorescent lamp or an LED is used for backlight, where the power is supplied by continuous voltage, the supply voltage may simply be reduced to a lower value, again resulting in power consumption reduction.

FIG. 4B shows another power supply scenario for an ELP backlight, where the supply power 420 is 100% duty cycles (continuous) during the low ambient light phase 422. Again a lower rate duty cycle may be used in the high ambient light phase 424, reducing the overall power consumption of the display. It should be noted, however, that in practical designs a frequency threshold for the traditional light source is taken into consideration such that a human eye does not perceive flickering.

Figure 5:
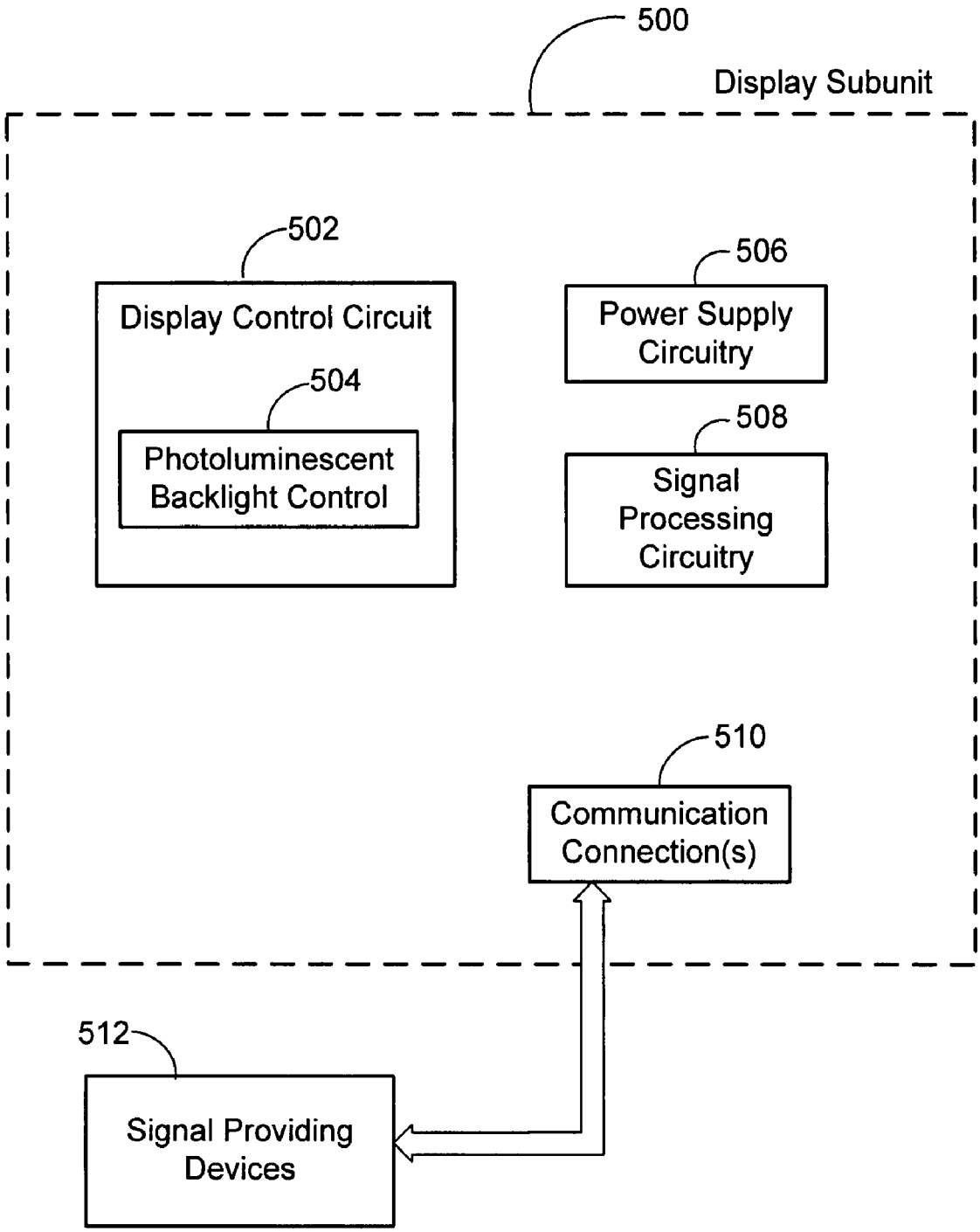
FIG. 5 is a block diagram of an example display subunit, where embodiments may be implemented.

FIG. 5 and the associated discussion are intended to provide a brief, general description of a suitable environment in which embodiments may be implemented. With reference to FIG. 5 a block diagram of an example display subunit, where embodiments may be implemented, is described.

Control mechanisms for phospho-luminescent backlight support material may be implemented as a combination of hardware and software modules. As discussed earlier, panel displays, where embodiments may be implemented, can be anything between small displays part of a handheld device and very large displays that are used for road side advertising, etc.

A display subunit 500 according to embodiments, may include display control circuit 502 that provides control signals to the display rendering still or video images on the display. Display control circuit 502 may include a photo-luminescent backlight control unit 504 that is arranged to activate backlight support material and/or reduce active backlight power (e.g. ELP).

Display control circuit 502 may also adjust screen properties in conjunction with phospho-luminescent backlight control 504 support. For example, transparency of a transreflective LCD panel or contrast of the screen may be adjusted to affect the light amount for charging the phospho-luminescent backlight support material.

Display subunit 500 may further include power supply circuitry 506 for various components of the display (e.g. display panel, auxiliary displays, backlight, and the like). Signal processing circuitry 508 may include physical circuits and software modules for processing signals received from an external or internal source to render still or video images.

Communication connections 510 may include circuitry and software components to facilitate communication with signal providing devices 512 (for the images to be displayed) through direct connection, network communication, and other methods. Communication connections 510 may allow the display subunit 500 to communicate with other devices over a wired or wireless network, for example, an intranet or the Internet. Communication connections 510 are one example of communication media. Communication media may typically be embodied by computer readable instructions, data structures, program modules, or other data in a modulated data signal, such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. The term computer readable media as used herein includes both storage media and communication media.

Display subunit 500 may include additional components such as additional processing units, memory circuits (volatile, non-volatile, or some combination of the two), data storage devices (removable and/or non-removable) such as, for example, magnetic disks, optical disks, or tape. Such components are well known in the art and need not be discussed at length here.

The claimed subject matter also includes methods. These methods can be implemented in any number of ways, including the structures described in this document. One such way is by machine operations, of devices of the type described in this document.

Another optional way is for one or more of the individual operations of the methods to be performed in conjunction with one or more human operators performing some. These human operators need not be collocated with each other, but each can be only with a machine that performs a portion of the program.

Figure 6:
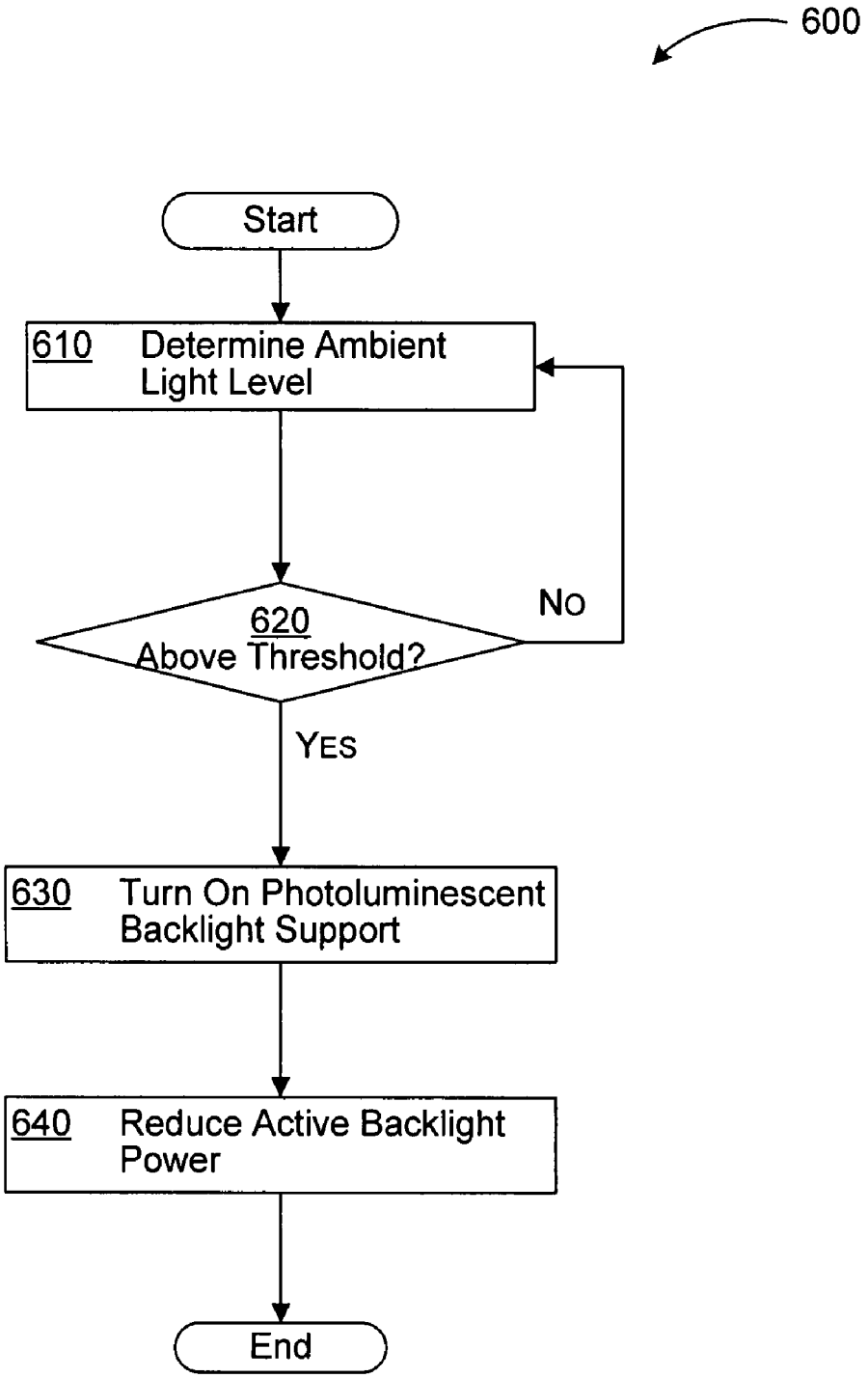
FIG. 6 illustrates a logic flow diagram for a process of using photoluminescence to support backlight in display.

FIG. 6 illustrates a logic flow diagram for a process of using photoluminescence to support backlight in display. Process 600 may be implemented as part of a display control module in a display device.

Process 600 begins with operation 610, where an ambient light level is determined. As discussed previously, the ambient light level may include the natural light form the environment and/or light from an active backlight system. Processing advances from operation 610 to decision operation 620.

At decision operation 620, a determination is made whether the ambient light level is above a predetermined threshold for activating phospho-luminescent backlight support material. If the ambient light level is below the predetermined threshold, processing returns to operation 610. Otherwise, processing moves to operation 630.

At operation 630, phospho-luminescent backlight support material is turned on, providing additional backlight to the display. Processing moves from operation 630 to operation 640.

At operation 640, the power for the active backlight system (e.g. ELP) is reduced since additional backlight is available from the phospho-luminescent backlight support material, resulting in power consumption savings for the display. After operation 640, processing also moves to a calling process for further actions.

The operations included in process 600 are for illustration purposes. Phospho-luminescent backlight support may be implemented by similar processes with fewer or additional steps, as well as in different order of operations using the principles described herein.

The above specification, examples and data provide a complete description of the manufacture and use of the composition of the embodiments. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims and embodiments.

What is claimed is:

1. A system for providing photo-luminescent backlight support to a display, the system comprising:

a first substrate of photo-luminescent material attached to at least a portion of the display, the first substrate of photo-luminescent material being responsive to charging via ambient light to provide lighting to the display; and a control circuit arranged to perform actions including:

determining whether an ambient light level available to the display is above a predetermined threshold;

if the ambient light level is above the predetermined threshold, activating the first photo-luminescent material substrate to provide lighting to the display, wherein the first photo-luminescent material substrate is activated upon charging by the ambient light; and reducing a power supply to an active backlight component to reduce an active backlight provided to the display by the active backlight component.

2. The system of claim 1, further comprising:

the active backlight component for providing backlight to the display, wherein the active backlight component includes at least one from a set of: a cathode fluorescent lamp, an Electroluminescent Panel (ELP), and a Light Emitting Diode (LED).

3. The system of claim 1, wherein the first photo-luminescent substrate includes phosphor-luminescent material.

4. The system of claim 2, wherein reducing the power supply to the active backlight component includes one of: reducing a duty cycle of a supply voltage and reducing an amplitude of a supply voltage.

5. The system of claim 1, wherein the control circuit is arranged to adjust at least one of a transparency and a contrast level of the display based on an ambient light level for charging the first substrate of photo-luminescent material.

6. The system of claim 1, further comprising a second substrate of photo-luminescent material attached to another portion of the display, wherein the first and the second substrates of photo-luminescent material have distinct luminescence properties.

7. The system of claim 6, wherein the first and the second substrates of photo-luminescent material are employed to provide distinct backlights to different segments of the display such that the different segments are perceived as functionally distinct images.

8. The system of claim 6, wherein the first and the second substrates of photo-luminescent material provide backlight at different wavelengths.

9. The system of claim 8, wherein the first and the second substrates of photo-luminescent material are used to enhance a color performance of the display.

10. The system of claim 1, wherein the predetermined threshold is dynamically adjusted based on a display property.

11. A system for providing photo-luminescent backlight support to a display, the system comprising:

a first photo-luminescent material embedded to at least a portion of the display, the first photo-luminescent material being responsive to charging via ambient light to provide lighting to the display;

an active backlight component for providing an active backlight to the display;

a control circuit arranged to perform actions including:

determining whether an ambient light level available to the display is above a predetermined threshold;

if the ambient light level is above the predetermined threshold, activating the first photo-luminescent material to provide lighting to the display, wherein the first photo-luminescent material is activated upon charging by the ambient light; and reducing a power supply to the active backlight component to reduce the active backlight provided to the display; and an ambient light sensor arranged to provide the control circuit information associated with the available ambient light level.

12. The system of claim 11, further comprising:

a second photo-luminescent material embedded to another portion of the display, wherein the first and the second photo-luminescent materials have distinct luminescence properties.

13. The system of claim 12, wherein the first and the second photo-luminescent materials provide backlight at different wavelengths.

14. The system of claim 13, wherein the first and the second photo-luminescent materials are used to enhance a color performance of the display.

15. The system of claim 11, wherein the first and the second photo-luminescent are embedded in each pixel of the display.

16. The system of claim 11, wherein the first and the second photo-luminescent materials are configured such that they have an enhanced period of luminescence following charging by the available ambient light.

17. A method to be executed at least in part in a display control device for providing photo-luminescent backlight support to a display, the method comprising:

determining whether an ambient light level available to the display is above a predetermined threshold;

if the ambient light level is above the predetermined threshold, activating a photo-luminescent material embedded to at least a portion of the display, the first substrate of photo-luminescent material being responsive to charging via ambient light to provide lighting to the display; wherein the photo-luminescent material is activated upon charging by the ambient light;

reducing a power supply to an active backlight component to reduce an active backlight provided to the display by the active backlight component.

18. The method of claim 17, further comprising:

adjusting at least one of a transparency and a contrast level of the display based on an ambient light level for charging the photo-luminescent material.

19. The method of claim 17, further comprising:

dynamically adjusting the predetermined threshold based on at least one from a set of: the available ambient light level, a contrast level of the display, a color temperature of the displayed image, and a transparency of the display.

20. The method of claim 17, further comprising:

analyzing a color composition and a format of the displayed image; and activating at least a portion of the photo-luminescent material based on a result of the analysis, wherein the photo-luminescent material is embedded to a plurality of portions of the display.

* * * * *